US008624784B2

(12) United States Patent
Mizutani et al.

(10) Patent No.: US 8,624,784 B2
(45) Date of Patent: Jan. 7, 2014

(54) MICROSTRIP ARRAY ANTENNA

(75) Inventors: Akiyoshi Mizutani, Nagoya (JP); Tetsuya Katayama, Aichi-ken (JP); Kento Nakabayashi, Anjo (JP)

(73) Assignee: DENSO CORPORATION, Kariya (JP)

( * ) Notice: Subject to any disclaimer, the term of this patent is extended or adjusted under 35 U.S.C. 154(b) by 394 days.

(21) Appl. No.: 12/650,012

(22) Filed: Dec. 30, 2009

(65) Prior Publication Data

US 2010/0171666 A1 Jul. 8, 2010

(30) Foreign Application Priority Data

Jan. 7, 2009 (JP) ..... 2009-001557

(51) Int. Cl.
*H01Q 1/38* (2006.01)
*H01Q 21/00* (2006.01)

(52) U.S. Cl.
USPC ..... 343/700 MS; 343/824; 343/893

(58) Field of Classification Search
USPC ..... 343/700 MS, 824, 893
See application file for complete search history.

(56) References Cited

U.S. PATENT DOCUMENTS

| | | | | |
|---|---|---|---|---|
| 3,995,277 A * | 11/1976 | Olyphant, Jr. | ..... | 343/846 |
| 5,367,307 A | 11/1994 | Dupuis et al. | | |
| 6,424,298 B1 | 7/2002 | Nishikawa et al. | | |
| 8,058,998 B2 * | 11/2011 | Burnside et al. | ..... | 340/572.7 |

FOREIGN PATENT DOCUMENTS

| | | | | |
|---|---|---|---|---|
| JP | 7-86826 | * | 3/1995 | |
| JP | 11-251833 | * | 9/1999 | ..... H01Q 21/08 |
| JP | A-11-251833 | | 9/1999 | |
| JP | 2001-044752 A | | 2/2001 | |
| JP | A-2008-258852 | | 10/2008 | |

OTHER PUBLICATIONS

Office Action mailed on Nov. 30, 2010 issued from the Japanese Patent Office in the corresponding Japanese patent application No. 2009-001557 (and English translation).

Office Action dated Jul. 2, 2012 in corresponding CN Application No. 201010002068.5 (and English translation).

* cited by examiner

*Primary Examiner* — Robert Karacsony
(74) *Attorney, Agent, or Firm* — Posz Law Group, PLC

(57) ABSTRACT

The present invention provides, as one aspect, a microstrip array antenna including a dielectric substrate, on a back face of which a conductive grounding plate is formed, and a strip conductor formed on the dielectric substrate. The strip conductor comprises a feeding strip line which extends in an extension direction, and at least two radiation antenna elements. At least one of the antenna elements is connected with one side of the strip line, and at least one of the antenna elements is connected with the other side of the strip line. The longitudinal directions of the antenna elements are parallel to each other and are at an angle of other than 90° with respect to the extension direction. The strip line has a bending shape and fully extends in the extension direction so that the antenna elements are connected with the strip line at the same angle.

17 Claims, 8 Drawing Sheets

A-A SECTIONAL VIEW

MICROSTRIP ARRAY ANTENNA

CROSS REFERENCE TO RELATED APPLICATION

This application is based on and claims the benefit of priority from earlier Japanese Patent Application No. 2009-1557 filed Jan. 7, 2009, the description of which is incorporated herein by reference.

BACKGROUND OF THE INVENTION

1. Technical Field of the Invention

The present invention relates to a microstrip array antenna using a dielectric substrate.

2. Related Art

A microstrip array antenna, which comprises a strip conductor formed on a dielectric substrate, has advantages in thinness, low cost of manufacturing, and productivity. Due to these features, microstrip array antennas have been widely used as transmitting and receiving antennas for various radio wave sensors such as a vehicle-mounted radar used in, for example, anticollision systems and adaptive cruise controls (ACC).

One example of the above microstrip array antenna is known in which a plurality of radiation antenna elements are connected with and arranged at a predetermined interval along the two sides of the linearly disposed feeding strip line.

When the microstrip array antenna configured as described above is installed in a vehicle as, for example, an automotive radar, the feeding strip line is commonly disposed so as to be perpendicular to the ground so that the antenna can totally obtain a desired radiation pattern (especially, radiation pattern in the vertical direction). Meanwhile, plane polarization inclined at a predetermined angle (for example, 45° with respect to the ground is preferably used as a radio wave transmitted/received by the microstrip array antenna to prevent interference with a radiated wave from an oncoming vehicle.

Accordingly, a microstrip array antenna is proposed in, for example, Japanese Patent Application Laid-open No. 2001-44752. In this microstrip array antenna, while the whole antenna is disposed in the vertical direction, radiation antenna elements are connected with and arranged along the sides of the feeding strip line so as to incline with respect to the longitudinal direction of the feeding strip line to realize plane polarization inclining with respect to the ground.

SUMMARY OF THE INVENTION

The present invention has been made in consideration of the foregoing conventional situation, and an object of the present invention is to provide a microstrip array antenna in which plane polarization is realized whose direction is inclined at a predetermined angle with respect to a feeding strip line, and directivities of radiation antenna elements of both sides of the feeding strip line have an approximately symmetry characteristic.

In order to achieve the object, the present invention provides, as one aspect, a microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, the longitudinal directions of the radiation antenna elements are parallel to each other and are at an angle of other than 90° with respect to the extension direction, and the feeding strip line has a partially or totally bent shape and fully extends in the extension direction so that the radiation antenna elements are connected with the feeding strip line at the same angle.

DETAILED DESCRIPTION OF THE PREFERRED EMBODIMENTS

Hereinafter, preferred embodiments of the present invention will be described with reference to the accompanying drawings.

Figure 1:
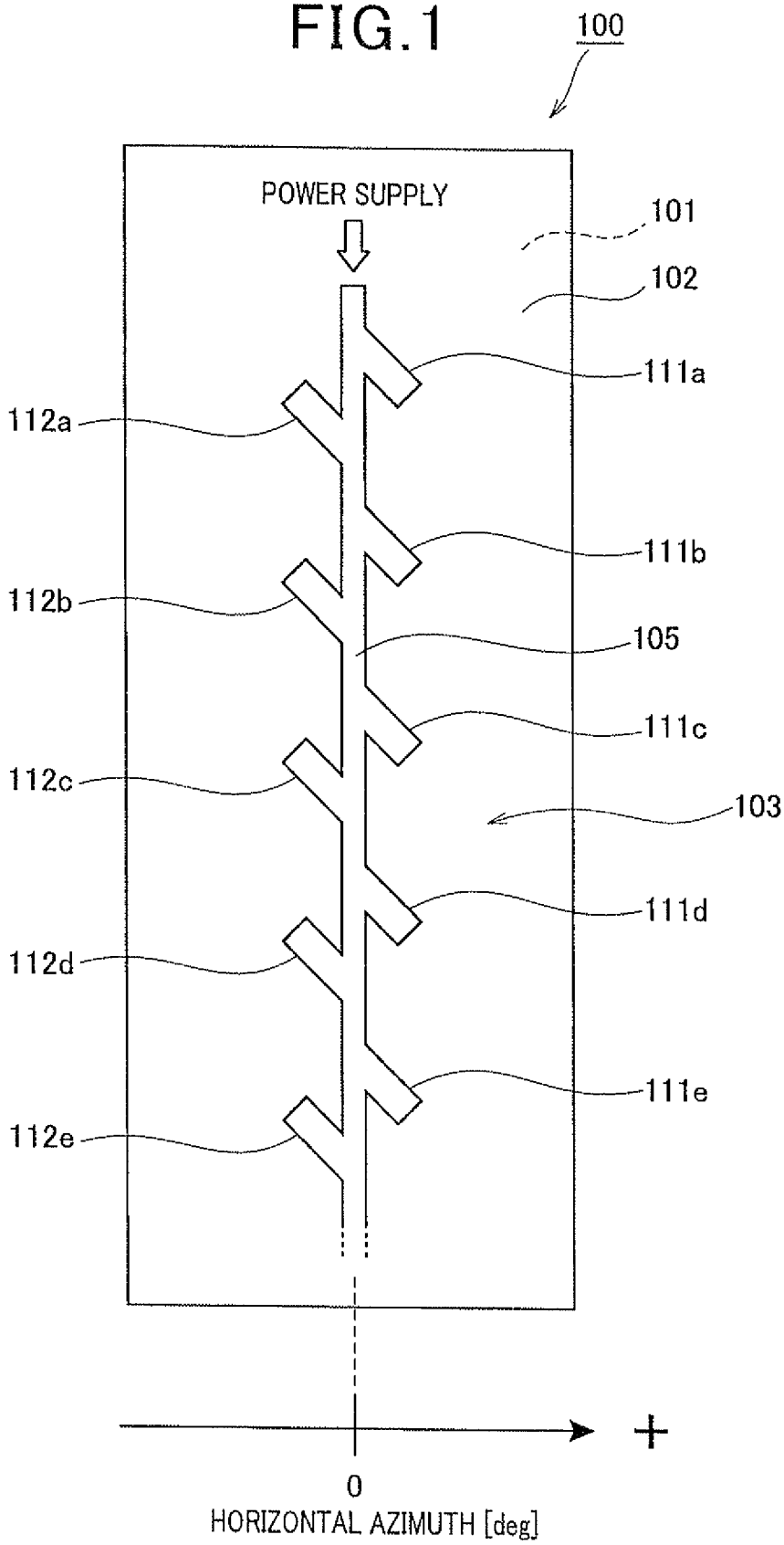
FIG. 1 is a diagram showing a configuration of a conventional microstrip array antenna.

FIG. 1 shows one example of a microstrip array antenna in which radiation antenna elements are connected with and arranged along a feeding strip line in a state where the radiation antenna elements incline with respect to the longitudinal direction of the feeding strip line. A microstrip array antenna 100 shown in FIG. 1 is configured by forming a strip conductor 103 on a dielectric substrate 102. On the back face of the dielectric substrate 102, a conductive grounding plate 101 is formed.

The strip conductor 103 comprises a feeding strip line 105 which is is linearly disposed, a plurality of radiation antenna elements 111*a*, 111*b*, 111*c*, 111*d*, 111*e*, . . . , which are connected with one side of the feeding strip line 105, and a plurality of radiation antenna elements 112*a*, 112*b*, 112*c*,

112*d*, 112*e*, . . . , which are connected with the other side of the feeding strip line 105, which are main parts.

The radiation antenna elements 111*a* to 111*e*, . . . , 112*a* to 112*e*, . . . are connected with the two sides of the feeding strip line 105 so as to be parallel to one another. In this case, the longitudinal directions of the radiation antenna elements are at an angle of 45° with respect to the longitudinal direction of the feeding strip line 105. According to the above configuration, the microstrip array antenna can transmit/receive plane polarization whose direction inclines at an angle of 45° with respect to the longitudinal direction of the feeding strip line 105.

However, when a plurality of the microstrip array antennas 100 shown in FIG. 1 are arranged in the horizontal direction to configure an automotive radar (which may be referred to as "automotive radar configuration") which produces the desired radiation, sidelobes in the radiation pattern characteristic of the automotive radar configuration rises.

Figure 2:
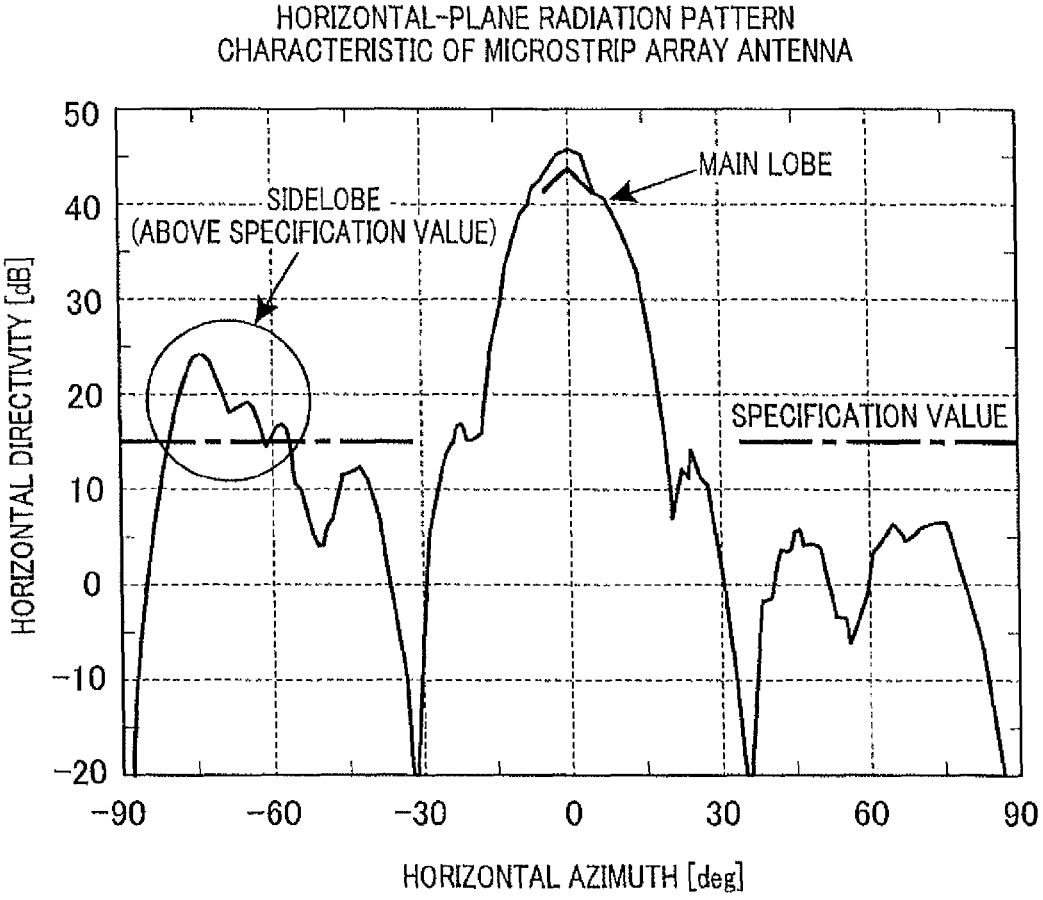
FIG. 2 is a diagram showing a horizontal-plane radiation pattern characteristic of the conventional microstrip array antenna configured as an automotive radar.

FIG. 2 shows one example of a radiation pattern characteristic (horizontal-plane radiation pattern characteristic) when the microstrip array antenna 100 has the automotive radar configuration. As shown in FIG. 2, in the radiation pattern characteristic of the microstrip array antenna 100 having the automotive radar configuration, symmetry of sidelobes with respect to a main lobe is broken. One of the sidelobes exceeds a specification value (upper limit) for the sidelobes required for a microstrip array antenna configuring an automotive radar.

As described above, when the microstrip array antenna 100 is used as an automotive radar, and the level of the unnecessary sidelobe rises and exceeds the specification value, various problems, such as appearance of a ghost, can arise.

To solve the problems, the inventors of the present application have variously analyzed and examined the cause of the rise of the sidelobe in the horizontal-plane radiation pattern characteristic when the conventional microstrip array antenna 100 shown in FIG. 1 has an automotive radar configuration. In consequence, the main reason has been found that connection angles of the radiation antenna elements with respect to the feeding strip line 105 (in other words, power supply branch angles between the feeding strip line 105 and the radiation antenna elements) differ between the two sides of the feeding strip line 105.

Figure 3A:
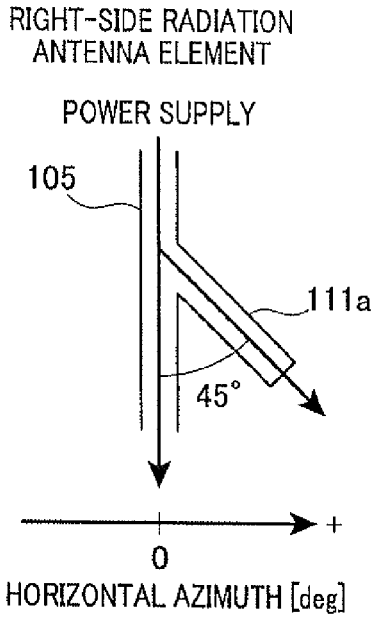
FIG. 3A is a diagram showing a characteristic of a single radiation antenna element configuring the conventional microstrip array antenna and showing a configuration of a right-side radiation antenna element.
Figure 3B:
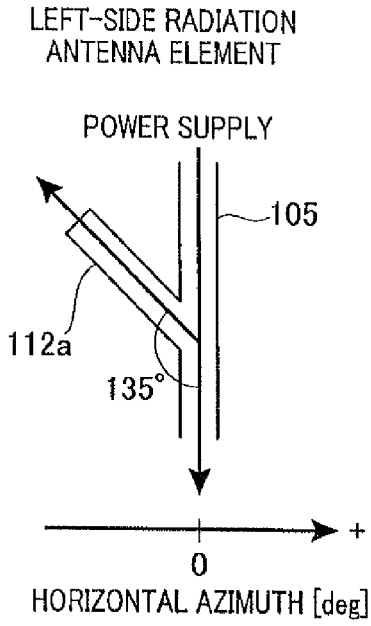
FIG. 3B is a diagram showing a configuration of a left-side radiation antenna element.

That is, in the conventional microstrip array antenna 100, as shown in FIG. 3A, the radiation antenna elements 111*a* and the like (which may be, hereinafter, referred to as "right-side radiation antenna element") are connected with one side of the feeding strip line 105 at an angle of 45° with respect to the longitudinal direction of the feeding strip line 105 (that is, power supply direction). Meanwhile, as shown in FIG. 3B, the radiation antenna elements 112*a* and the like (which may be, hereinafter, referred to as "left-side radiation antenna element") are connected with the other side of the feeding strip line 105 at an angle of 135° with respect to the longitudinal direction of the feeding strip line 105.

Figure 3C:
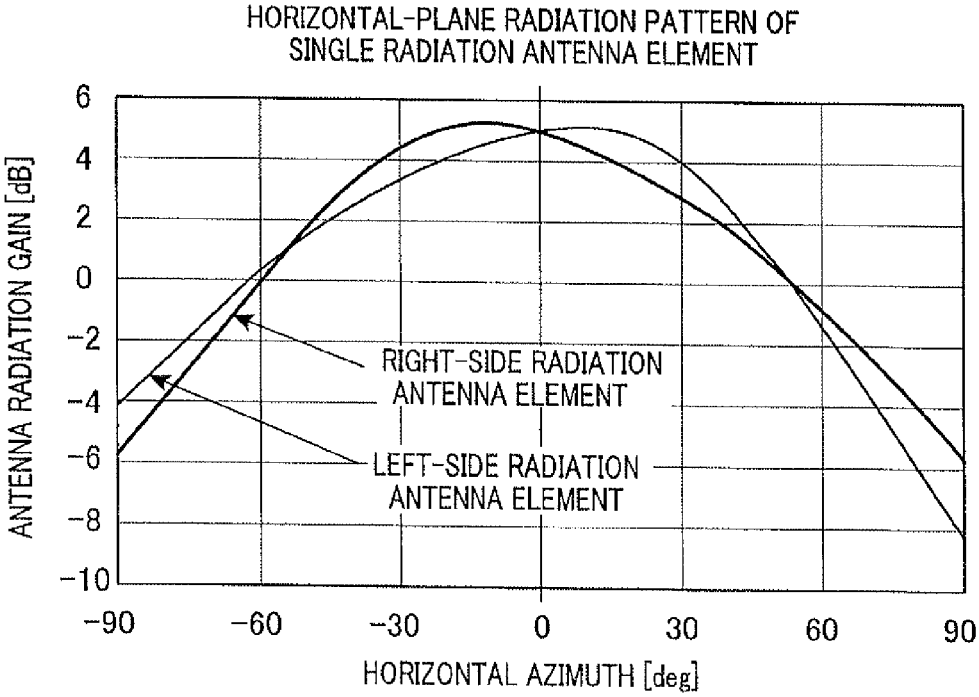
FIG. 3C is a diagram showing a horizontal-plane radiation pattern characteristic of the radiation antenna elements.

When the connection angles of the radiation antenna elements with respect to the feeding strip line 105 (power supply branch angles) differ between the right-side radiation antenna element and the left-side radiation antenna element, directivities of the single right-side radiation antenna element and the single left-side radiation antenna element have an asymmetry characteristic as shown in FIG. 3C. In addition, peak levels at which gains are maximized are slightly different from each other.

As shown in FIG. 1, the microstrip array antenna 100 is configured by arranging the right-side radiation antenna elements and the left-side radiation antenna elements, whose radiation pattern characteristics are asymmetric, in the vertical direction. The microstrip array antenna 100 is configured as an automotive radar. In this case, as shown in FIG. 2, in the radiation pattern of the microstrip array antenna 100, right and left sidelobes are asymmetric, and the level of the unnecessary sidelobe rises and may exceed the specification value.

(1) A Basic Configuration of a Microstrip Array Antenna

Figure 4:
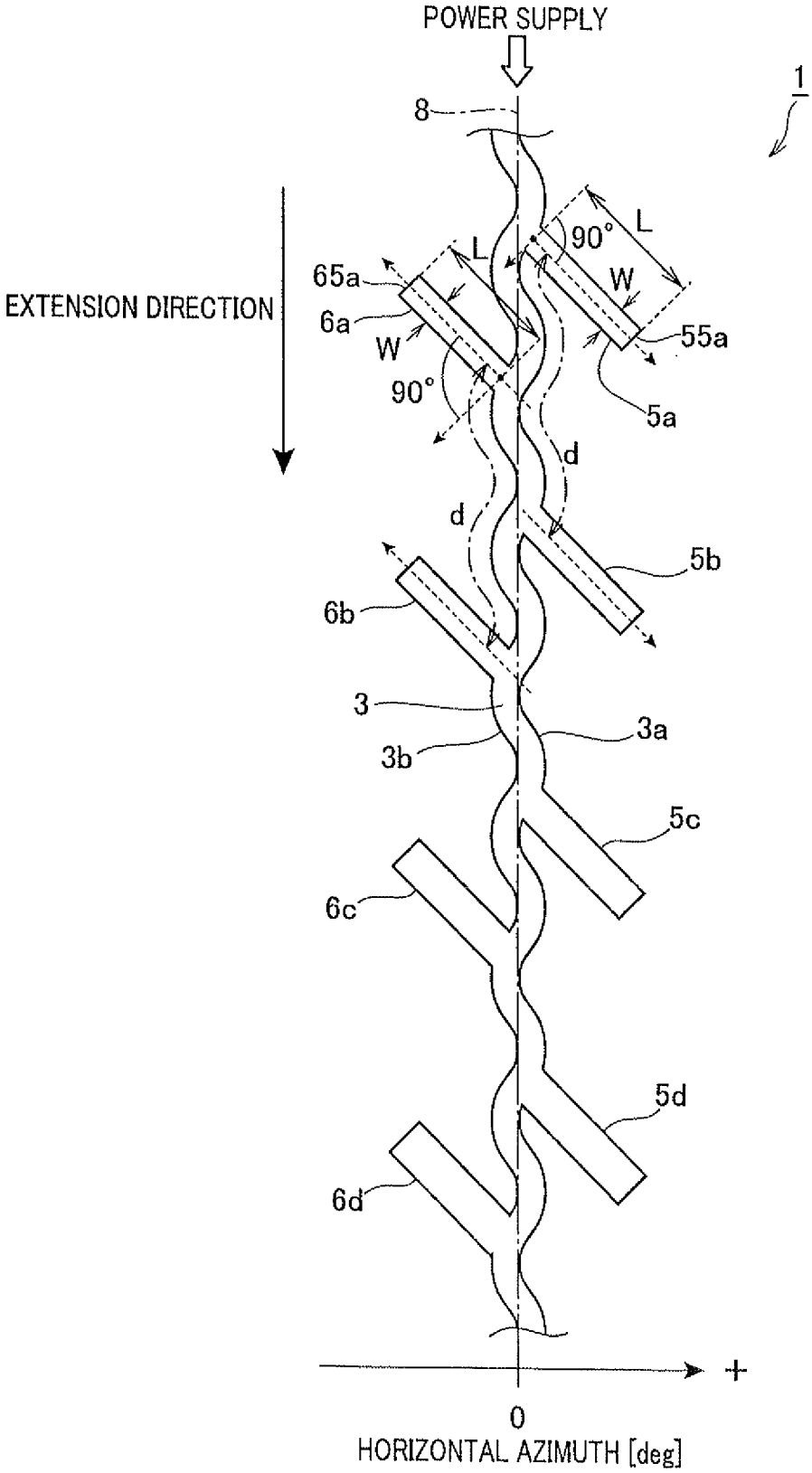
FIG. 4 is a diagram showing a basic configuration of a microstrip array antenna of an embodiment.

FIG. 4 is a drawing showing a microstrip array antenna of an embodiment according to the present invention. A microstrip array antenna 1 shown in FIG. 4 is configured by forming a strip conductor on a dielectric substrate. On the back face of the dielectric substrate, a conductive grounding plate is formed. FIG. 4 shows only the strip conductor which has the most characteristic configuration in the microstrip array antenna 1. First, the configuration of the strip conductor of the microstrip array antenna 1 will be described with reference to FIG. 4.

As shown in FIG. 4, the strip conductor of the microstrip array antenna 1 comprises a feeding strip line 3 and a plurality of radiation antenna elements 5*a*, 5*b*, 5*c*, 5*d*, . . . , 6*a*, 6*b*, 6*c*, 6*d*, . . . , which are the main parts. The feeding strip line 3 extends in a predetermined extension direction (downward direction shown in FIG. 4). The radiation antenna elements 5*a*, 5*b*, 5*c*, 5*d*, . . . , 6*a*, 6*b*, 6*c*, 6*d*, . . . are connected with and arranged along two sides of the feeding strip line 3.

The feeding strip line 3 has a continuously meandering shape, such as an S-shape, and totally extends in the extension direction. That is, when a straight line parallel to the extension direction is defined as an imaginary straight line 8, the feeding strip line 3 extends along the imaginary straight line 8 as in a smooth S-shape.

The strip-shaped radiation antenna elements 5*a*, 5*b*, 5*c*, 5*d*, . . . are connected with (protruded from) a first side 3*a* which is one of the two sides of the feeding strip line 3. The strip-shaped radiation antenna elements 6*a*, 6*b*, 6*c*, 6*d*, . . . are connected with (protruded from) a second side 3*b* which is the other of the two sides of the feeding strip line 3.

Next, configurations of the radiation antenna elements 5*a*, 5*b*, 5*c*, 5*d*, . . . connected with the first side 3*a* will be described, taking the radiation antenna element 5*a* as an example. The length L of the radiation antenna element 5*a* (the distance between the contact point with the feeding strip line 3 and a field emission edge line 55*a* which is an open end) is approximately one-half of a wavelength λg (i.e. approximately λg/2) of a radio wave propagating through the strip conductor (hereinafter, referred to as "in-line wavelength λg").

The radiation antenna element 5*a* is disposed at an angle of 45° with respect to the extension direction (imaginary straight line 8) and is connected with the feeding strip line 3 at an angle of 90°.

That is, since the feeding strip line 3 has a meandering shape, such as an S-shape, the direction of the line varies along the S-shape when viewed locally. The radiation antenna element 5*a* is connected with the S-shaped feeding strip line 3 so as to be at an angle of 45° with respect to the direction of the line at the connecting portion. That is, the radiation antenna element 5*a* is protruded from the connecting portion of the feeding strip line 3 so as to extend in the direction of the normal to the line.

In addition, the field emission edge line 55*a* (which is in the direction orthogonal to the field emission direction of a radiated radio wave), which is a side of an outline edge line of the radiation antenna element 5*a*, is parallel to the direction of the line of the feeding strip line 3 at the connecting portion. The field emission edge line 55*a* is at an angle of 45° with respect to the extension direction (imaginary straight line 8).

The radiation antenna elements 5*b*, 5*c*, 5*d*, . . . connected with the first side 3*a* basically have the same configuration as that of the radiation antenna element 5*a* described above. Each of the radiation antenna elements 5*b*, 5*c*, 5*d*, . . . has a length L of λg/2. Each of the radiation antenna elements 5*b*, 5*c*, 5*d*, . . . is arranged so as to be at an angle of 45° with respect to the extension direction, and is connected with the feeding strip line 3 so as to be at an angle of 90° with respect to the feeding strip line 3.

The interval d between the respective radiation antenna elements 5*a*, 5*b*, 5*c*, 5*d*, . . . which are connected along the first side 3*a* is the same as the in-line wavelength λg. That is, the strip-shaped radiation antenna elements are connected with and arranged along the first side 3*a* at the same interval d as the in-line wavelength λg. Since the radiation antenna elements 5*a*, 5*b*, 5*c*, 5*d*, . . . are at an angle of 45° with respect to the extension direction as described above, the longitudinal directions of the radiation antenna elements 5*a*, 5*b*, 5*c*, 5*d*, . . . are parallel to one another.

Next, configurations of the radiation antenna elements 6*a*, 6*b*, 6*c*, 6*d*, . . . connected with the second side 3*b* will be described, taking the radiation antenna element 6*a* as an example. The radiation antenna element 6*a* basically has the same configuration as that of the radiation antenna element 5*a* connected with the first side 3*a*. The radiation antenna element 6*a* has a length L of λg/2. The radiation antenna element 6*a* is arranged so as to be at an angle of 45° with respect to the extension direction (imaginary straight line 8), and is connected with the feeding strip line 3 so as to be at an angle of 90° with respect to the feeding strip line 3. That is, the radiation antenna element 6*a* is protruded from the connecting portion of the feeding strip line 3 so as to extend in the direction of the normal to the line.

In addition, the field emission edge line 65*a*, which is a side of an outline edge line of the radiation antenna element 6*a*, is parallel to the in direction of the line of the feeding strip line 3 at the connecting portion. The field emission edge line 65*a* is at an angle of 45° with respect to the extension direction (imaginary straight line 8).

The radiation antenna elements 6*b*, 6*c*, 6*d*, . . . connected with the second side 3*b* basically have the same configuration as that of the is radiation antenna element 6*a* described above. Each of the radiation antenna elements 6*b*, 6*c*, 6*d*, . . . has a length L of λg/2. Each of the radiation antenna elements 6*b*, 6*c*, 6*d*, . . . is arranged so as to be at an angle of 45° with respect to the extension direction, and is connected with the feeding strip line 3 so as to be at an angle of 90° with respect to the feeding strip line 3.

The interval d between the respective radiation antenna elements 6*a*, 6*b*, 6*c*, 6*d*, . . . which are connected along the second side 3*b* is the same as the in-line wavelength kg. That is, the strip-shaped radiation antenna elements are connected with and arranged along the second side 3*b* at the same interval d as the in-line wavelength λg. Since the radiation antenna elements 6*a*, 6*b*, 6*c*, 6*d*, are at an angle of 45° with respect to the extension direction as described above, the longitudinal directions of the radiation antenna elements 6*a*, 6*b*, 6*c*, 6*d*, . . . connected with the second side 3*b* are parallel to one another. The longitudinal directions of the radiation antenna elements 6*a*, 6*b*, 6*c*, 6*d*, . . . are parallel to those of the radiation antenna elements 5*a*, 5*b*, 5*c*, 5*d*, . . . .

The radiation antenna elements 6*a*, 6*b*, 6*c*, 6*d*, . . . , arranged along the second side 3*b* are connected with portions corresponding to middle portions between adjacent two of the radiation antenna elements 5*a*, 5*b*, 5*c*, 5*d*, . . . , arranged along the first side 3*a*. Specifically, in FIG. 4, the radiation antenna element 6*a*, which is included in the radiation antenna elements connected with the second side 3*b*, nearest to the power supply side is connected with a portion corresponding to a middle portion between the radiation antenna elements 5*a* and 5*b* connected with the first side 3*a*. That is, the radiation antenna element 6*a* is connected with a portion corresponding to a middle portion of a path between a connecting position of the radiation antenna element 5*a* and a connecting position of the radiation antenna element 5*b*. Other radiation antenna elements are connected in the same manner.

In consequence, the radiation antenna elements are alternately connected with and arranged along two sides of the feeding strip line 3 at regular intervals.

In the microstrip array antenna 1 configured as described above, as electric power supplied from the input terminal (the upper side in FIG. 4) propagates toward the termination (the lower side in FIG. 4), parts of the electric power are sequentially coupled with the radiation antenna elements connected with the sides 3*a* and 3*b* of the feeding strip line 3 and are radiated from the radiation antenna elements. The remaining parts of the electric power propagate to the termination. Therefore, the electric power propagating through the feeding strip line 3 gradually attenuates when approaching the termination.

In addition, since the longitudinal directions of the radiation antenna elements are parallel to one another, all the field emission directions of the radiated radio waves are the same (parallel to one another). That is, all the radiation antenna elements radiate radio waves whose planes of polarization of main polarization components are parallel to one another. The planes of polarization (field emission directions) are inclined at an angle of 45° with respect to the extension direction of the feeding strip line 3. Therefore, when using the microstrip array antenna 1 disposed so that the extension direction thereof is perpendicular to the ground, radio waves can be transmitted/received whose plane polarization is at an angle of 45° with respect to the ground.

Meanwhile, widths W of the radiation antenna elements 5*a*, 5*b*, 5*c*, 5*d*, . . . , 6*a*, 6*b*, 6*c*, 6*d*, . . . gradually become larger from the input terminal (the upper side in FIG. 4) for electric power. That is, the width W of the radiation antenna element which is closest to the input terminal is the smallest, and the width W of the radiation antenna element which is closest to the termination (the lower side in FIG. 4) is the largest.

As described above, the width W of the radiation antenna element varies depending on the connecting position of the feeding strip line 3 to equalize radiant quantities from the radiation antenna elements, which is one example of the present embodiment.

To equalize the radiant quantities from the radiation antenna elements, for the radiation antenna element closer to the input terminal side, where large electric power propagates through the feeding strip line 3, it is required to decrease the width W thereof and the bonding amount with respect to the feeding strip line 3. Conversely, for the radiation antenna element closer to the termination side, where less electric power propagates through the feeding strip line 3, it is required to increase the width W thereof and the bonding amount with respect to the feeding strip line 3.

Note that equalizing the radiant quantities from the radiation antenna elements is described as one example. The widths W of the radiation antenna elements are properly determined according to various specifications, characteristics or the like required for the microstrip array antenna 1.

That is, excitation amplitudes to be realized in the radiation antenna elements are previously determined according to radiation pattern characteristics or the like required for the microstrip array antenna 1. Therefore, the widths W of the radiation antenna elements are determined so as to have distributions corresponding to the excitation amplitudes, which produces the desired excitation amplitudes.

(2) Characteristics of the Radiation Antenna Elements

Figure 5A:
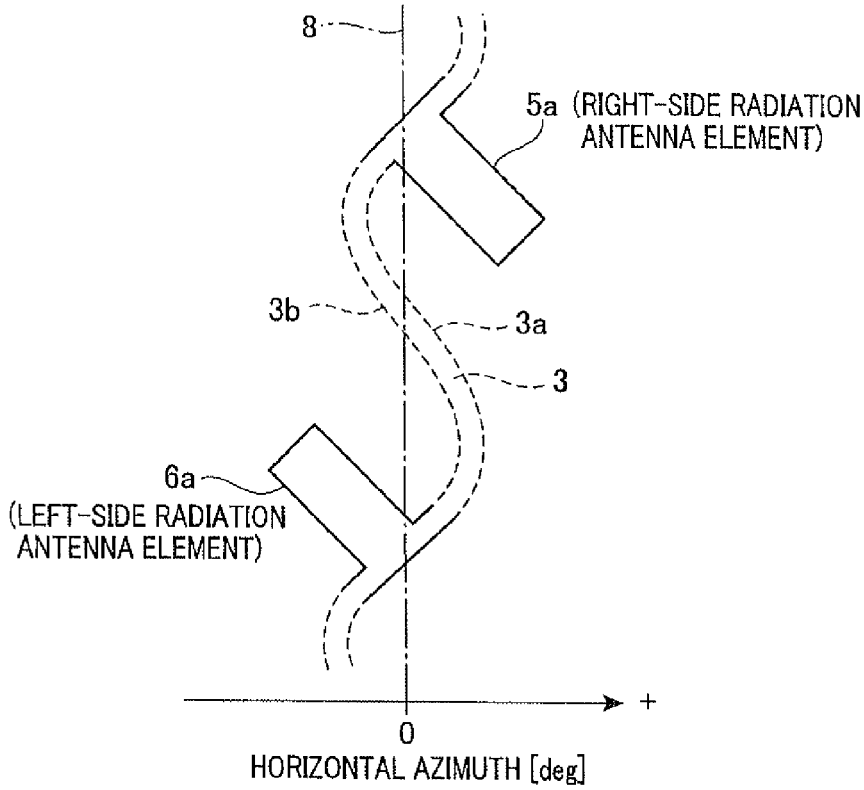
FIG. 5A is a diagram showing a characteristic of a single radiation antenna element and showing a relation between a right-side radiation antenna element and a left-side radiation antenna element.

Next, characteristics of the radiation antenna elements 5*a*, 5*b*, 5*c*, 5*d*, . . . , 6*a*, 6*b*, 6*c*, 6*d*, . . . as a single element configuring the microstrip array antenna 1 will be described with reference to FIGS. 5A and 5B. As shown in FIG. 5A, a characteristic of the radiation antenna elements 5*a*, 5*b*, 5*c*, 5*d*, . . . (which may be, hereinafter, referred to as "right-side radiation antenna elements) as a single element, which are connected with the first side 3*a* which is one of the two sides of the feeding strip line 3, will be described, taking the radiation antenna element 5*a* as an example. Meanwhile, a characteristic of the radiation antenna elements 6*a*, 6*b*, 6*c*, 6*d*, . . . (which may be, hereinafter, referred to as "left-side radiation antenna elements) as a single element, which are connected with the second side 3*b*, will be described, taking the radiation antenna element 6*a* as an example.

In the microstrip array antenna 1, the longitudinal direction of the right-side radiation antenna element 5*a* and the longitudinal direction of the left-side radiation antenna element 6*a* are parallel to each other. The right-side radiation antenna element 5*a* and the left-side radiation antenna element 6*a* are connected with the feeding strip line 3 at the same angle (90° in the embodiment).

In the conventional microstrip array antenna, as shown in FIGS. 3A and 3B, the power supply branch angle with respect to the feeding strip line differs between the right-side radiation antenna element and the left-side radiation antenna element. However, in the microstrip array antenna 1 of the present embodiment, as shown in FIGS. 4 and 5A, each part of the electric power supplied from the input terminal of the feeding strip line 3 and propagating through the feeding strip line 3 branches (coupling) at connecting portion of the radiation antenna element at the same power supply branch angle, which is 90°.

Figure 5B:
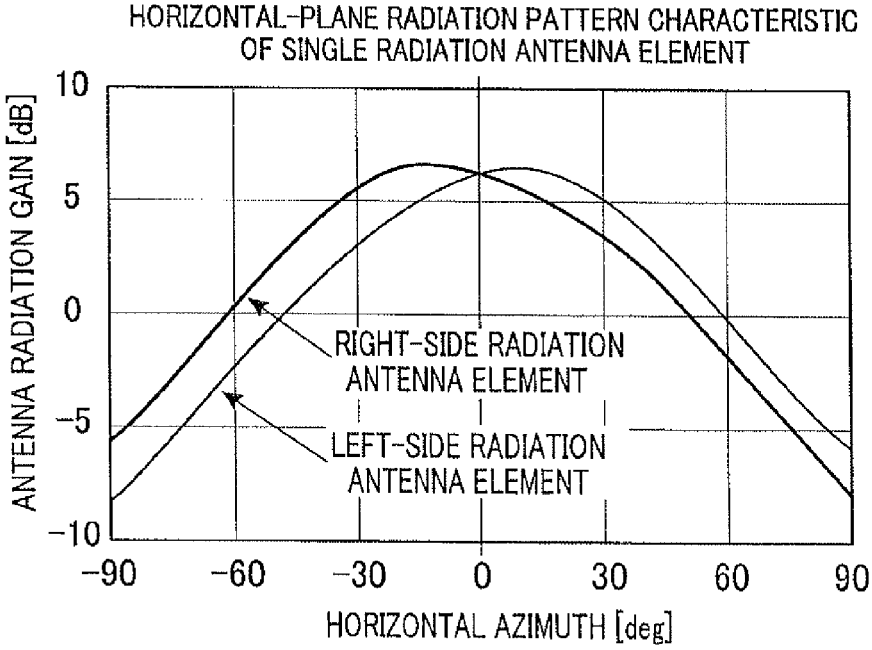
FIG. 5B is a diagram showing a horizontal-plane radiation pattern characteristic of the single radiation antenna elements.

Consequently, radiation pattern characteristics (horizontal-plane radiation pattern characteristic) of the single right-side radiation antenna element 5*a* and the single left-side radiation antenna element 6*a* have mirror symmetry characteristics as shown in FIG. 5B. In addition, peak levels at which gains are maximized are substantially equal to each other.

(3) A Specific Configuration of a Microstrip Array Antenna

Figure 6A:
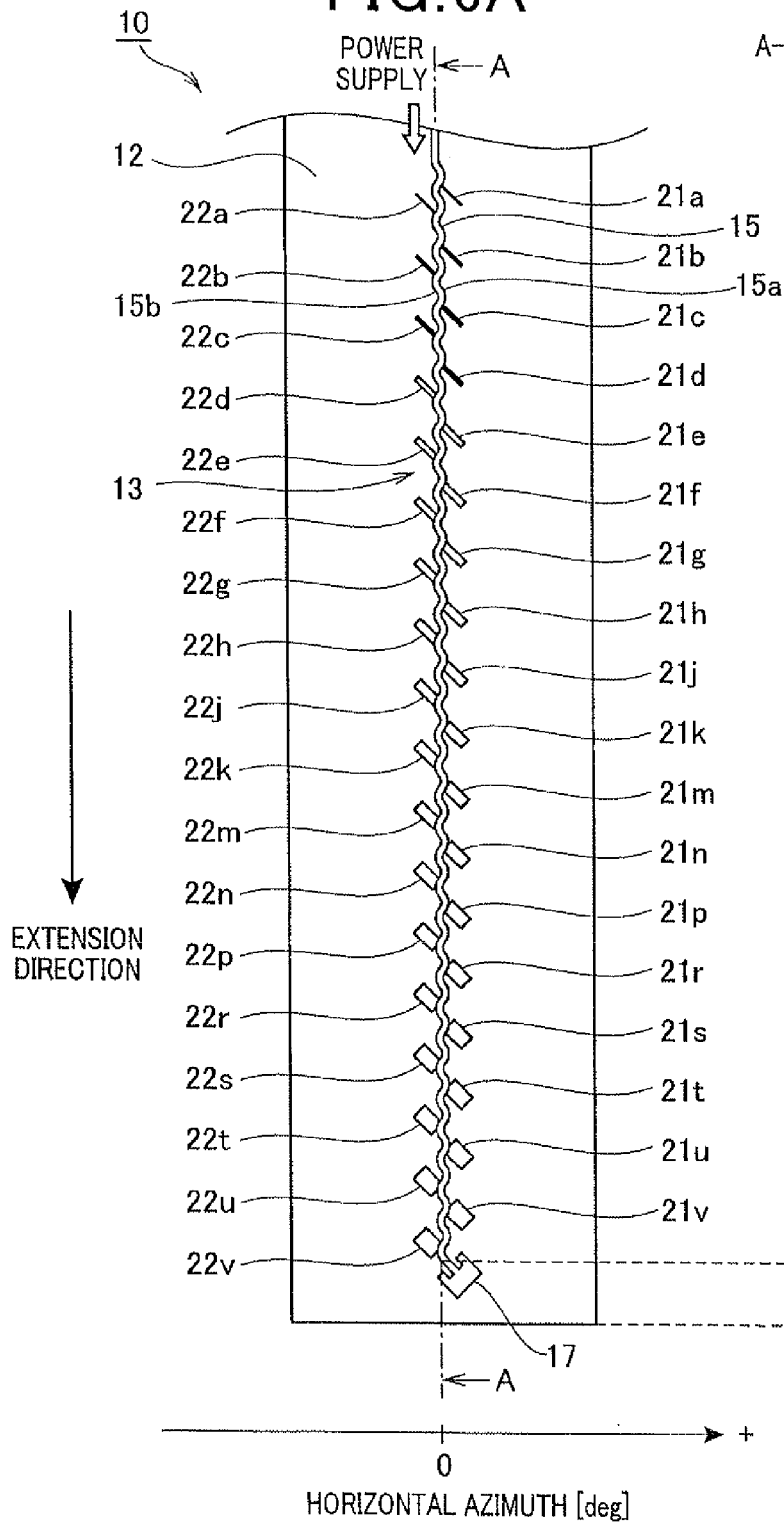
FIG. 6A is a plane view showing a specific configuration of a microstrip array antenna of another embodiment.
Figure 6B:
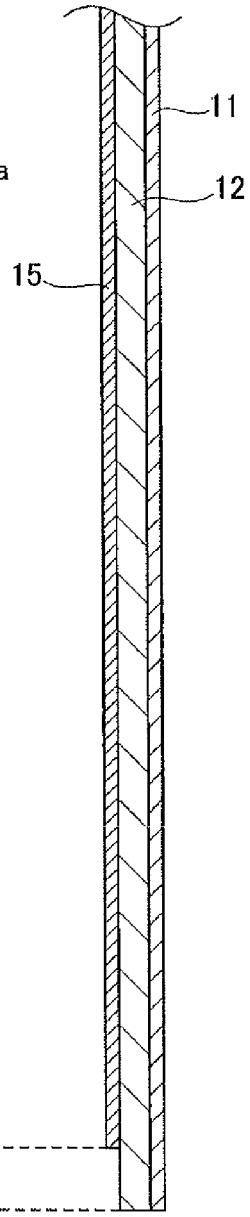
FIG. 6B is a sectional view taken along a line A-A in FIG. 6A.

Next, a more specific configuration of a microstrip array antenna of to an embodiment according to the present invention will be described with reference to FIGS. 6A and 6B. FIG. 6A is a plane view of a microstrip array antenna 10. FIG. 6B is a sectional view taken along a line A-A in FIG. 6A. The microstrip array antenna 10 shown in FIG. 6A is configured by forming a strip conductor 13 on a dielectric substrate 12. On the back is face of the dielectric substrate 12, a conductive grounding plate 11 is formed.

The strip conductor 13 comprises a feeding strip line 15 and a plurality of radiation antenna elements 21*a* to 21*v*, 22*a* to 22*v*, which are main parts. The feeding strip line 15 extends in a predetermined extension direction. The radiation antenna elements 21*a* to 21*v*, 22*a* to 22*v* are connected with and arranged along the two sides of the feeding strip line 15.

As electric power supplied from the input terminal of the feeding strip line 15 propagates toward the termination side, parts of the electric power are sequentially coupled with the radiation antenna elements 21*a* to 21*v*, 22*a* to 22*v* connected with the two sides of the feeding strip line 15 and are radiated from the radiation antenna elements. The remaining parts of the electric power propagate to the termination side.

A microstrip antenna element 17 for effectively radiating the residual electric power is disposed on the termination of the feeding strip line 15. Note that a matching terminal element for absorbing the residual electric power may be disposed instead of the microstrip antenna element 17. The configuration of the termination of the feeding strip line 15 can be properly determined.

The feeding strip line 15 has a smoothly meandering shape, such as an S-shape, and extends in the extension direction as with the feeding strip line 3 of the microstrip array antenna 1 shown in FIG. 4.

The radiation antenna elements 21*a* to 21*v* are connected with a first side 15*a*, which is one of the two sides of the feeding strip line 15, and are arranged at an interval of a wavelength of λg of a radio wave to propagating through the feeding strip line 15. Similarly, the radiation antenna elements 22*a* to 22*v* are connected with a second side 15*b*, which is the other of the two sides of the feeding strip line 15, and are arranged at an interval of a wavelength of λg.

The shapes and arrangement of the radiation antenna elements of the microstrip array antenna 10 are basically similar to those of the microstrip array antenna 1 shown in FIG. 4. That is, the length of the elements is λg/2, and the longitudinal directions of the radiation antenna elements are parallel to one another and are at an angle of 45° with respect to the extension direction. In addition, the radiation antenna elements are connected with the feeding strip line 15 at an angle of 90°. Furthermore, widths of the radiation antenna elements gradually become larger from the input terminal for electric power to the termination to equalize radiant quantities from the radiation antenna elements.

Note that, in the microstrip array antenna 10, a predetermined number of the radiation antenna elements included in the radiation antenna elements 21*a* to 21*v* and 22*a* to 22*v* and close to the termination side have rectangular shapes. Each one corner of the radiation antenna elements are connected with the feeding strip line 15. Specifically, nine radiation antenna elements 21*k* to 21*v* positioned at the termination side and connected with the first side 15*a* and nine radiation antenna elements 22*k* to 22*v* positioned at the termination side and connected with the second side 15*b* have rectangular shapes. Each one corner of the radiation antenna elements 21*k* to 21*v* and 22*k* to 22*v* are connected with the feeding strip line 15.

In the microstrip array antenna 10 of the embodiment, as shown in FIG. 6A, the radiation antenna element closer to the termination side has a larger width. When the width of the element becomes large, a radio wave radiated from the radiation antenna element includes a large number of unnecessary cross polarization components which intersect the main polarization components (which are parallel to the longitudinal direction of the radiation antenna element and are at an angle of 45° with respect to the extension direction), in addition to the main polarization components.

To solve the above problem, regarding the radiation antenna elements whose widths are larger, each one corner thereof is connected with the feeding strip line 15 to decrease the width of the portion connecting with the feeding strip line 15. Consequently, the unnecessary cross polarization components are prevented from being generated.

Figure 7:
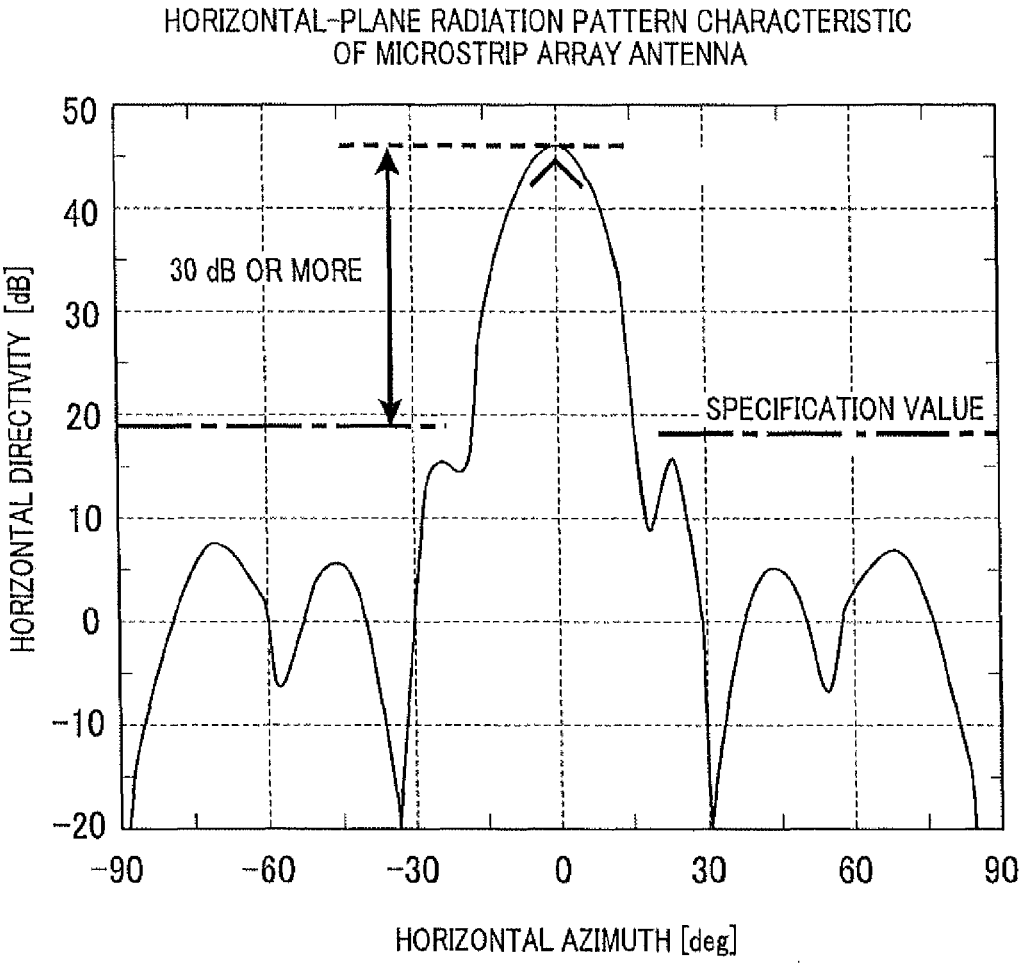
FIG. 7 is a diagram showing a horizontal-plane radiation pattern characteristic of the microstrip array antenna of the embodiment configured as an automotive radar.

FIG. 7 shows a horizontal-plane radiation pattern characteristic of the microstrip array antenna 10 shown in FIG. 6A and configured as described above. In this case, a plurality of the microstrip array antennas 10 are arranged in an array in the horizontal direction to configure, for example, an automotive radar which realizes desired radiation (automotive radar configuration). As shown in FIG. 7, the horizontal-plane radiation pattern characteristic of the microstrip array antenna 10 meets a specification in which the difference between a main lobe and sidelobes is 30 dB or more. The sidelobes display symmetry. Values of gain of the sidelobes are limited so as to be sufficiently lower than the specification value (upper limit). Consequently, the effect can be sufficiently recognized in which a radiation pattern characteristic of the single right-side radiation antenna element and the single left-side radiation antenna element (horizontal-plane radiation pattern characteristic) is realized as a mirror symmetry characteristic.

(4) Advantages of the Embodiment

In the microstrip array antenna of the embodiment described above, the radiation antenna elements are disposed at an angle of 45° with respect to the extension direction of the feeding strip line. The radiation antenna elements are configured so that each connecting angle (power supply branch angle) with respect to the feeding strip line is 90°. Specifically, the feeding strip line fully extends in the extension direction and has a smoothly meandering shape, such as an S-shape. Consequently, connections are realized between the feeding strip line and each of the radiation antenna elements at the same angle.

As described above, since all the radiation antenna elements disposed on both the sides of the feeding strip line (right-side radiation antenna elements and left-side radiation antenna elements) are connected with the feeding strip line at the same angle (or a substantially equivalent angle), radiation pattern characteristics of the single right-side radiation antenna element and the single left-side radiation antenna element can be realized which have a mirror symmetry characteristic as shown in FIG. 5B.

Consequently, according to the microstrip array antenna of the embodiment, plane polarization can be realized whose direction is inclined at a predetermined angle (45° in the embodiment) with respect to the extension direction of the feeding strip line. In addition, an excellent radiation pattern characteristic can be realized in which unnecessary sidelobes are suppressed.

In addition, the feeding strip line has an S-shape. The radiation antenna elements are connected with the feeding strip line at an angle of 90° (right angle). Therefore, compared with a case where the radiation antenna elements are connected at an angle of other than 90°, the shape of the feeding strip line can be simplified. That is, the shape in which the radiation antenna elements are connected at an angle of 90° can be easily realized.

In addition, the feeding strip line does not have bent corners and has a totally smooth shape. Therefore, the feeding strip line can be prevented from radiating useless electric power, thereby providing a more efficient microstrip array antenna.

Furthermore, a plurality of the radiation antenna elements are connected with the sides of the feeding strip line at a predetermined interval d (in-line wavelength λg in the embodiment). Thereby, a so-called series-feed microstrip array antenna is realized. Therefore, a higher efficiency microstrip array antenna can be provided which can restrict loss of fed electric power and easily obtain a desired radiation pattern characteristic (refer to FIG. 7).

(Modifications)

It will be appreciated that the present invention is not limited to the configurations described above, but any and all modifications, variations or equivalents, which may occur to those who are skilled in the art, should be considered to fall within the scope of the present invention.

In the microstrip array antenna 1 shown in FIG. 4, the feeding strip line 3 has a totally smooth and continuous S-shape, which is one example. For example, as shown in FIG. 8A, a microstrip array antenna 40 may be configured which comprises a feeding strip line 43 having a sawtooth shape.

The microstrip array antenna 40 comprises the feeding strip line 43, which has a sawtooth shape and extends along the extension direction, and radiation antenna elements 41*a*, 41*b*, 41*c*, . . . , 42*a*, 42*b*, 42*c*, . . . , which are connected with and arranged along two sides of the feeding strip line 43 at a predetermined angle (for example, 90°).

Figure 8A:
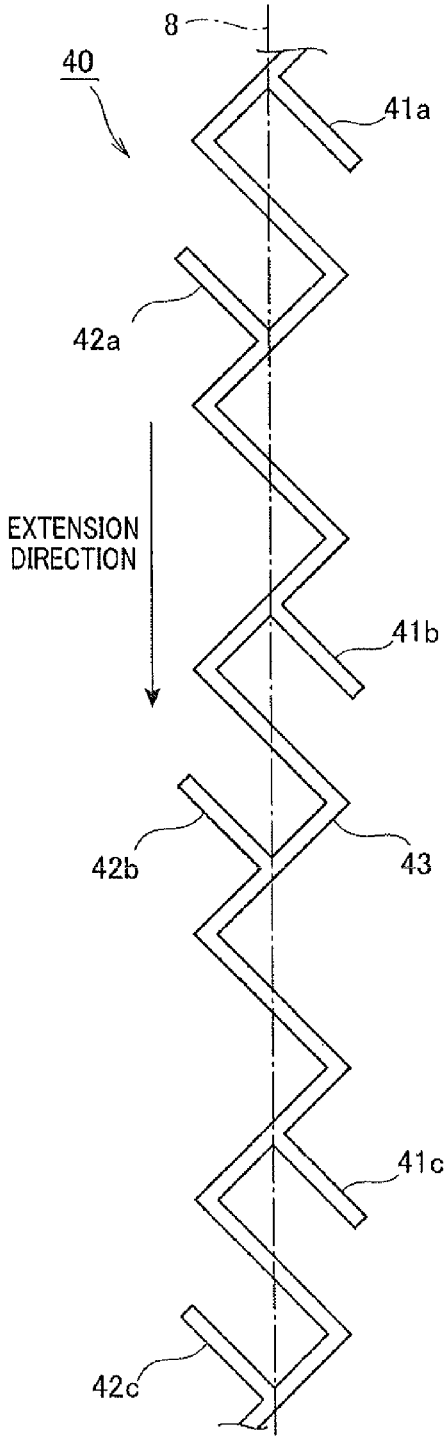
FIG. 8A is a diagram showing another example of the microstrip array antenna.

The microstrip array antenna 40 shown in FIG. 8A and described above can also realize plane polarization whose direction is inclined at a predetermined angle (for example, 45°) with respect to the extension direction of the feeding strip line 43 as in the cases of the microstrip array antennas shown in FIGS. 4 and 6A. In addition, an excellent radiation pattern characteristic can be realized in which unnecessary sidelobes are suppressed.

Note that the feeding strip line 43 of the microstrip array antenna 40 shown in FIG. 8A has bent portions including angular corners. Therefore, a leakage of electric power from the angular corners increases, which can decrease the efficiency of the whole antenna.

Figure 8B:
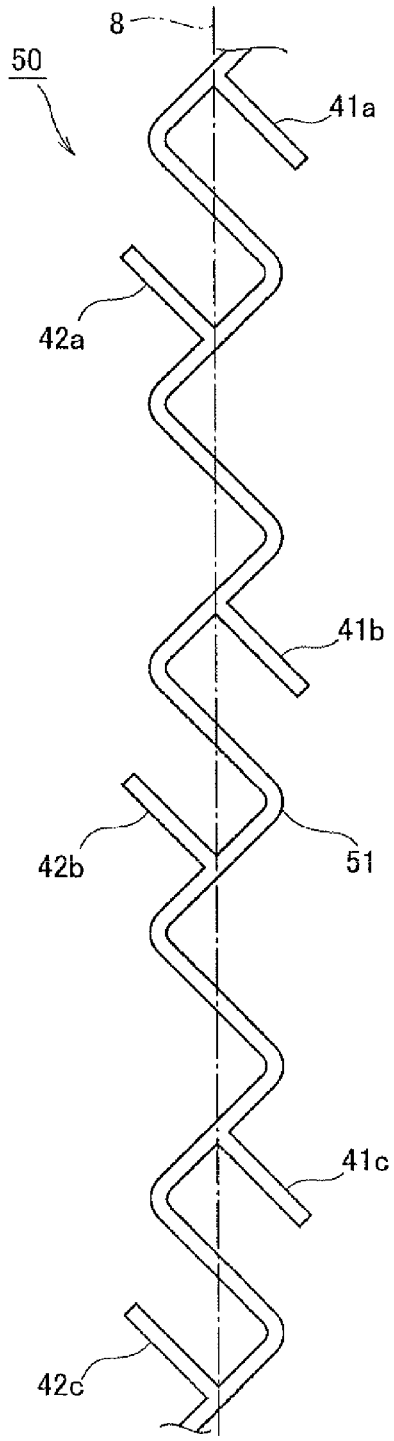
FIG. 8B is a diagram showing another example of the microstrip array antenna.

To solve the problem, as shown in FIG. 8B, it is more preferable that a feeding strip line 51 of a microstrip array antenna 50 has a smooth shape having rounded bent portions. Consequently, since the bent portions do not have angular corners, electric power can be prevented from radiating unnecessarily from the bent portions.

The above embodiments (FIGS. 4 and 6A) and FIGS. 8A and 8B show microstrip array antennas whose feeding strip line has a continuous S-shape or a sawtooth shape. However, the feeding strip lines may not always have shapes which continuously and regularly vary but have irregularly bending shapes.

That is, as long as the feeding strip line extends in a predetermined extension direction overall, and all the radiation antenna elements are connected at the same angle when locally seen, the bending shape of the feeding strip line is not specially limited.

In addition, in the above embodiment, the interval between the respective radiation antenna elements which are connected with the two sides is approximately λg/2, which is one example. The interval between the radiation antenna elements can be properly determined. For example, on the basis of λg, the interval may be determined so as to be shorter (or longer) than λg depending on connecting positions of the feeding strip line 3 or a relation between the radiation antenna elements.

In the above embodiment, the radiation antenna elements 6*a*, 6*b*, 6*c*, 6*d*, . . . , arranged along the second side 3*b* are connected with portions corresponding to middle portions between adjacent two of the radiation antenna elements 5*a*, 5*b*, 5*c*, 5*d*, . . . , arranged along the first side 3*a*. That is, the radiation antenna elements arranged along one side are connected with portions corresponding to middle portions between adjacent two radiation antenna elements arranged along the other side, which is one example. The positional relationship between the radiation antenna elements arranged along one side and the radiation antenna elements arranged along the other side can be properly determined.

In addition, one radiation antenna element may be connected with each of the two sides of the feeding strip line. That is, the number of the radiation antenna elements is not limited.

In the above embodiment, the longitudinal directions of the radiation antenna elements are at an angle of 45° with respect to the extension direction of the feeding strip line, which is one example. The angle at which the radiation antenna elements are disposed with respect to the extension direction can be properly determined, except for a case where the longitudinal directions are parallel to or perpendicular to the extension direction.

In addition, the radiation antenna elements are connected with the feeding strip line an angle of 90°, which is one example. The radiation antenna elements may be connected at an angle of other than 90°.

In the above embodiments, the extension direction of the feeding strip line is defined as a specified direction (longitudinal direction of the imaginary straight line 8). However, the extension direction is not necessarily the specified (one) direction. That is, the imaginary line 8 may not be a straight line but may be a line having a partially or totally bending shape. Even in this case, the feeding strip line fully extends along the bending imaginary line (in the extension direction) and totally or partially bends. Due to the shape, all the radiation antenna elements can be connected at the same angle as in the above case.

Aspects of the above-described embodiments will then be summarized.

To solve the above-described problems, the inventors of the present application have taken into consideration that connection angles of the radiation antenna elements of both the sides with respect to the feeding strip line (power supply branch angles) are the same. That is, the present invention is achieved by taking into consideration that electric power is supplied to the radiation antenna elements of both the sides at the same angle with respect to the power supply direction.

To solve the above-described problems, the present invention provides, as one aspect, a microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, the longitudinal directions of the radiation antenna elements are parallel to each other and are at an angle of other than 90° with respect to the extension direction, and the feeding strip line has a partially or totally bending shape and fully extends in the extension direction so that the radiation antenna elements are connected with the power supply strip at the same angle.

In the microstrip array antenna configured as described above, the feeding strip line does not have a straight shape such as the conventional microstrip array antenna 100 shown in FIG. 1 but have a partially or totally bending shape. Note that although the microstrip array antenna has a bending shape when partially viewed, the microstrip array antenna fully extends in the predetermined extension direction.

The feeding strip line is bent as described above so that all the radiation antenna elements arranged along the two sides of the feeding strip line are connected with the feeding strip line at an equivalent angle.

That is, as long as the feeding strip line is totally straight, the right-side radiation antenna element differs from the left-side radiation antenna element in connecting angles (power supply branch angles) by 180° as in the case of the conventional microstrip array antenna 100 shown in FIG. 1.

To solve the above problem, while the feeding strip line totally extends in the predetermined extension direction, the feeding strip line partially or totally bends. Consequently, the radiation antenna elements are connected with the feeding strip line at the same angle.

According to the microstrip array antenna configured as described above, the longitudinal directions of the radiation antenna elements are parallel to each other and are at an angle of other than 90° with respect to the extension direction of the feeding strip line. In addition, the radiation antenna elements are connected with both the sides of the feeding strip line at the same angle. Therefore, while plane polarization is realized whose direction is inclined at a predetermined angle with respect to the feeding strip line, radiation patterns of the single right-side radiation antenna element and the single left-side radiation antenna element can be realized which have an approximate mirror symmetry characteristic.

In the microstrip array antenna, the radiation antenna elements are connected with the feeding strip line at an angle of 90°.

When the radiation antenna elements are connected with the feeding strip line at the same angle, the angle can be properly determined. However, depending on the angle, the feeding strip line may be required to be largely or intricately bent, whereby the shape of the feeding strip line is required to be complicated.

However, when the radiation antenna elements are connected at an angle of 90°, the shape of the feeding strip line can be simplified.

In the microstrip array antenna, the bending shape of the feeding strip line includes a smooth curve.

The feeding strip line can be bent so as to have a corner having a predetermined angle as in saw teeth. The microstrip array antenna may be formed by using the feeding strip line having such a bent corner.

However, when the feeding strip line has such a bent corner, part of electric power propagating the feeding strip line is radiated from the bent portion, which causes loss of electric power.

To solve the above problem, the feeding strip line is formed so that the bent portion thereof includes a smooth curve. Consequently, the feeding strip line can be prevented from radiating useless electric power from the bent portion, which can provide a more efficient microstrip array antenna.

In the microstrip array antenna, the feeding strip line has a continuously meandering substantial S-shape.

Since the feeding strip line has an S-shape, the shape of the feeding strip line can be simplified, and the configuration can be easily realized in which the radiation antenna elements are connected with the feeding strip line at an angle of 90°. In addition, due to the S-shape, the feeding strip line totally and smoothly bends, thereby improving radiation efficiency.

In the microstrip array antenna, each of the sides of the feeding strip line connects with a plurality of the radiation antenna element.

According to the microstrip array antenna configured as described above, a so-called series-feed microstrip array antenna is realized in which the radiation antenna elements are connected with the sides of the feeding strip line. Therefore, a higher efficiency microstrip array antenna can be provided which can reduce loss of fed electric power and easily obtain a desired radiation pattern characteristic.

According to the microstrip array antenna, the radiation antenna elements connected with the one side of the feeding strip line are connected with portions corresponding to middle portions between each adjacent two of the radiation antenna elements connected with the other side of the feeding strip line.

According to the microstrip array antenna configured as described above, the radiation antenna elements connected with two sides of the feeding strip line are alternately arranged along the feeding strip line. Therefore, radio waves can be efficiently radiated and received.

What is claimed is:

1. A microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, longitudinal directions of the radiation antenna elements are parallel to each other and are at an angle of other than 90° with respect to the extension direction, the feeding strip line has a partially or totally bending shape and fully extends in the extension direction so that the radiation antenna elements are connected with the feeding strip line at the same angle, the radiation antenna elements are connected with the feeding strip line so that the longitudinal directions of the radiation antenna elements are at an angle of 90° with respect to the feeding strip line, and the radiation antenna elements connected with the two sides of the feeding strip line are alternately arranged along the feeding strip line.

2. The microstrip array antenna according to claim 1, wherein the bending shape of the feeding strip line includes a smooth curve.

3. The microstrip array antenna according to claim 2, wherein the feeding strip line has a continuously meandering substantial S-shape.

4. The microstrip array antenna according to claim 1, wherein each of the sides of the feeding strip line connects with a plurality of the radiation antenna elements.

5. The microstrip array antenna according to claim 4, wherein the radiation antenna elements connected with the one side of the feeding strip line are connected with portions corresponding to middle portions between each adjacent two of the radiation antenna elements connected with the other side of the feeding strip line.

6. The microstrip array antenna according to claim 1, wherein a side of an outline edge line of each of the radiation antenna elements is parallel to the feeding strip line at a connecting portion between the feeding strip line and the radiation antenna element, and the side of the outline edge line is at an angle of 45° with respect to the extension direction.

7. The microstrip array antenna according to claim 1, wherein widths of the radiation antenna elements gradually become larger as the radiation antenna elements are further away from an input terminal that supplies electric power to the feeding strip line.

8. A microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, longitudinal directions of the radiation antenna elements are parallel to each other and are at an angle of other than 90° with respect to the extension direction, the feeding strip line has a partially or totally bending shape and fully extends in the extension direction so that the radiation antenna elements are connected with the feeding strip line at the same angle, the radiation antenna elements are connected with the feeding strip line at an angle of 90°, a side of an outline edge line of each of the radiation antenna elements is parallel to the feeding strip line at a connecting portion between the feeding strip line and the radiation antenna element, the side of the outline edge line is at an angle of 45° with respect to the extension direction, and the radiation antenna elements connected with the two sides of the feeding strip line are alternately arranged along the feeding strip line.

9. The microstrip array antenna according to claim 8, wherein the bending shape of the feeding strip line includes a smooth curve.

10. The microstrip array antenna according to claim 9, wherein the feeding strip line has a continuously meandering substantial S-shape.

11. The microstrip array antenna according to claim 8, wherein each of the sides of the feeding strip line connects with a plurality of the radiation antenna elements.

12. The microstrip array antenna according to claim 11, wherein the radiation antenna elements connected with the one side of the feeding strip line are connected with portions corresponding to middle portions between each adjacent two of the radiation antenna elements connected with the other side of the feeding strip line.

13. The microstrip array antenna according to claim 8, wherein widths of the radiation antenna elements gradually become larger as the radiation antenna elements are further away from an input terminal that supplies electric power to the feeding strip line.

14. The microstrip array antenna according to claim 1, wherein the longitudinal directions of each of the radiation antenna elements which are parallel to each other are taken axially along a longitude of each of the radiation antenna elements.

15. The microstrip array antenna according to claim 8, wherein the longitudinal directions of each of the radiation antenna elements which are parallel to each other are taken axially along a longitude of each of the radiation antenna elements.

16. A microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, longitudinal directions of the radiation antenna elements are parallel to each other and are at an angle of other than 90° with respect to the extension direction, the feeding strip line has a partially or totally bending shape and fully extends in the extension direction so that the radiation antenna elements are connected with the feeding strip line at the same angle, the radiation antenna elements are connected with the feeding strip line so that the longitudinal directions of the radiation antenna elements are at an angle of 90° with respect to the feeding strip line, each of the sides of the feeding strip line connects with a plurality of the radiation antenna elements, and the radiation antenna elements connected with the one side of the feeding strip line are connected with portions corresponding to middle portions between each adjacent two of the radiation antenna elements connected with the other side of the feeding strip line.

17. A microstrip array antenna including a dielectric substrate, on a back face of which a conductive grounding plate is formed, and a strip conductor formed on the dielectric substrate, wherein the strip conductor comprises a feeding strip line which is linear and extends in a predetermined extension direction, and at least two radiation antenna elements which have a predetermined length, at least one of the radiation antenna elements being connected with one side of the feeding strip line, and at least one of the radiation antenna elements being connected with the other side of the feeding strip line, longitudinal directions of the radiation antenna elements are parallel to each other and are at an angle of other than 90° with respect to the extension direction, the feeding strip line has a partially or totally bending shape and fully extends in the extension direction so that the radiation antenna elements are connected with the feeding strip line at the same angle, the radiation antenna elements are connected with the feeding strip line at an angle of 90°, a side of an outline edge line of each of the radiation antenna elements is parallel to the feeding strip line at a connecting portion between the feeding strip line and the radiation antenna element, the side of the outline edge line is at an angle of 45° with respect to the extension direction, each of the sides of the feeding strip line connects with a plurality of the radiation antenna elements, and the radiation antenna elements connected with the one side of the feeding strip line are connected with portions corresponding to middle portions between each adjacent two of the radiation antenna elements connected with the other side of the feeding strip line.

* * * * *